US008925732B2

(12) United States Patent
Mohanka

(10) Patent No.: US 8,925,732 B2
(45) Date of Patent: Jan. 6, 2015

(54) SCREEN PANEL

(75) Inventor: Madan M. Mohanka, Kolkata (IN)

(73) Assignee: TEGA Industries Limited, Kolkata (IN)

( * ) Notice: Subject to any disclaimer, the term of this patent is extended or adjusted under 35 U.S.C. 154(b) by 71 days.

(21) Appl. No.: 13/388,007

(22) PCT Filed: Nov. 5, 2009

(86) PCT No.: PCT/IN2009/000546
§ 371 (c)(1),
(2), (4) Date: Apr. 20, 2012

(87) PCT Pub. No.: WO2011/013135
PCT Pub. Date: Feb. 3, 2011

(65) Prior Publication Data
US 2012/0199521 A1 Aug. 9, 2012

(51) Int. Cl.
*B07B 1/49* (2006.01)
*B07B 1/46* (2006.01)

(52) U.S. Cl.
CPC ..... *B07B 1/4645* (2013.01); *B07B 1/4609* (2013.01)
USPC ..... 209/397; 209/399

(58) Field of Classification Search
CPC ..... B07B 1/04; B07B 1/4609; B07B 1/469
USPC ..... 209/397, 399, 931
See application file for complete search history.

(56) References Cited

U.S. PATENT DOCUMENTS

| | | | | | |
|---|---|---|---|---|---|
| 1,718,385 | A * | 6/1929 | Sherwood | 209/397 |
| 3,018,891 | A * | 1/1962 | Bergstrom | 209/397 |
| 3,900,393 | A * | 8/1975 | Wilson | 209/399 |
| 3,972,974 | A * | 8/1976 | Pico | 264/267 |
| 3,980,555 | A * | 9/1976 | Freissle | 209/408 |
| 4,265,742 | A * | 5/1981 | Bucker et al. | 209/399 |
| 5,372,261 | A * | 12/1994 | Galton et al. | 209/399 |
| 6,254,729 | B1 * | 7/2001 | Doelle et al. | 162/251 |

FOREIGN PATENT DOCUMENTS

| | | | |
|---|---|---|---|
| AU | 589007 | 9/1989 | |
| FR | 2031091 | 11/1970 | |
| JP | 02026680 A * | 1/1990 | B07B 1/46 |
| WO | WO 2009/101481 | 8/2009 | |

OTHER PUBLICATIONS

International Search Report issued May 23, 2011 in connection with related PCT Application No. PCT/IN2009/00546.
IPRP and Written Opinion issued Jan. 31, 2012 in connection with related PCT Application No. PCT/IN2009/00546.

* cited by examiner

*Primary Examiner* — Michael McCullough
(74) *Attorney, Agent, or Firm* — Edwards Wildman Palmer LLP; Joshua L. Jones; Christopher J. Cillié

(57) ABSTRACT

A screen panel for mining and quarrying industries adapted to be mounted on a screen deck, including a screening surface made up of materials such as herein described formed on a reinforcing frame, said screening surface having suitably designed apertures of desired shape for allowing materials of desired size to pass through, said apertures having walls (2) made of abrasion resistant material such as herein described, whereby retention of said desired shape of said apertures is ensured for a substantially long period of time.

16 Claims, 2 Drawing Sheets

SCREEN PANEL

CROSS-REFERENCE TO RELATED APPLICATIONS

This application is the U.S. National Stage Application of PCT International Application No. PCT/IN2009/000546, filed on Nov. 5, 2009, which claim priority to Indian Patent Application No. 1020/KOL/2009, filed Jul. 30, 2009.

FIELD OF THE INVENTION

The present invention, in general relates to an improved screen panel for mining and quarrying industries and in particular to an improved screen panel adapted to withstand abrasion and to retain the desired shaped of its apertures for a substantially longer period of time.

BACKGROUND OF THE INVENTION

Traditionally, a wide range of screening arrangements, for screening/separating or grading of minerals in the mining and quarrying industries are known.

Screening panel system for ore screening decks that is now widely used by the mining industry, replaced the earlier screening cloths and large wire screening frames. These screening panels are known to be either of Rubber or Polyurethane with steel reinforcements. It is also known that such panels are manufactured by hot vulcanized method or casting. The panels are adapted to be secured with the support frame of the screen machine by bolting. The panels may also be secured to the frame with an alternate method using a pin and separate lug arrangement.

The screen panels known in the art, as described aforesaid, suffer from extensive wearing of the aperture walls, due to constant passage of undersized ores through them during operation. This extensive abrasion/wearing of the aperture walls results in substantially expedited loss in the desired shape of the apertures, rendering them unfit for the desired operational purposes. Research is on in this area for considerably long period of time to reduce the abrasion of the aperture walls, so that, the desired shapes thereof may be retained for a considerably long period of time and the concerned screen panels are not rendered ineffective, rather briskly, as is regularly known to happen at present. However, significant breakthrough in that perspective is yet to be achieved.

Accordingly there was a long felt need to design screen panels for its application in mining and quarrying industries, whose aperture walls are substantially abrasion resistant, to ensure retention of desired shape of the apertures for a considerably long period of time.

The present invention meets the aforesaid long felt need.

All through out the specification including the claims, the words "screen panel", "screen deck" "mining", "quarrying", "mineral", "ores", "walls", "button", "sleeve", "screening device", "screening deck", "abrasion resistant", "wear resistant" are to be interpreted in the broadest sense of the respective terms and includes all similar items in the field known by other terms, as may be clear to persons skilled in the art. Restriction/limitation, if any, referred to in the specification, is solely by way of example and understanding the present invention.

OBJECTS OF THE INVENTION

It is the principal object of the present invention to provide an improved screen panel for its application in mining and quarrying industries, which is adapted to resist abrasion during its operation and to retain the desired shape of its apertures for a substantially long period of time.

It is another object of the present invention to provide an improved screening device for screening mineral ores, which is adapted to prevent/substantially reduce the wearing of its aperture walls, thereby increasing the life of the panel.

It is a further object of the present invention to provide an improved screen panel having a substantially higher longevity which is flexible and is adapted for mounting on a screening deck, which includes a screening surface integrally formed on a reinforcing frame.

It is yet another object of the present invention to provide an improved screen panel having abrasion resistant lining on the walls of its apertures, whereby the flexibility of said apertures is enhanced and wear protection is also ensured.

It is a further object of the present invention to provide an improved screen panel having flexible aperture walls, thereby facilitating the mineral ores to pass through the apertures easily and also ensuring prevention of clogging.

It is another object of the present invention to provide a method for manufacturing an improved screen panel for its application in mining and quarrying industries, which is adapted to resist abrasion during its operation and to retain the desired shape of its apertures for a substantially long period of time.

It is a further object of the present invention to provide a screening deck for its application in the mining and quarrying industry, having mounted thereon at least a screen panel, which is adapted to resist abrasion during its operation and to retain the desired shape of its apertures for a substantially long period of time.

How the foregoing objects are achieved and the other aspects of the present invention will be clear from the following description which is purely by way of understanding and not by way of any sort of limitation.

SUMMARY OF THE INVENTION

Accordingly, the present invention provides a screen panel for mining and quarrying industries adapted to be mounted on a screen deck, including a screening surface made up of materials such as herein described formed on a reinforcing frame, said screening surface having suitably designed apertures of desired shape for allowing materials of desired size to pass through, said apertures having walls made of abrasion resistant material such as herein described, whereby retention of said desired shape of said apertures is ensured for a substantially long period of time.

In accordance with preferred embodiments of the present invention:

- said abrasion resistant material includes metallic lining along walls of said apertures.
- said metallic lining forms the metallic walls of said aperture and said metallic walls have a slit cut along the vertical line, thereby enhancing the flexibility of said apertures and also ensuring wear protection.
- said metallic walls with a slit along the vertical line, are adapted to be mounted on a steel reinforcement, such that it becomes an integral part of said reinforcement.
- said abrasion resistant material includes any one of or a combination of ceramics and cryston.
- said screening surface, other than said apertures, are made of any one of or a combination of mild steel, stainless steel, rubber and/or polyurethane with or without steel reinforcing.

said panel comprises of vulcanized material, rubber polyurethane, having embedded within it steel reinforcing bars, at the outer edges of said panel and extended across the inner area of said panel, thereby providing support to said screening surface.

said panel is adapted be of different sizes such as modular type (305*305 mm) or larger type (610*310 mm).

said panel is adapted to button type fixing to said screening deck or to sleeve type fixing to said screening deck.

The present invention also provides a method of manufacturing a screen panel for mining and quarrying industries adapted to be mounted on a screen deck, including forming a screening surface of materials such as herein described, on a reinforcing frame and designing apertures on said screening surface of desired shape for allowing materials of desired size to pass through, the walls of said aperture being constructed of abrasion resistant material such as herein described, thereby ensuring retention of said desired shape of said apertures for a substantially long period of time.

The present invention also provides a screening deck for mining and quarrying industries, having mounted thereon at least a screen panel, including a screening surface such as herein described formed on a reinforcing frame, said screening surface having suitably designed apertures of desired shape for allowing materials of desired size to pass through, said apertures having walls made of abrasion resistant material such as herein described, whereby retention of said desired shape of said apertures is ensured for a substantially long period of time.

BRIEF DESCRIPTION OF THE ACCOMPANYING DRAWINGS

The nature and scope of the present invention will be better understood from the accompanying drawings, which are by way of illustration of some preferred embodiments and not by way of any sort of limitation. In the accompanying drawings, FIG. 1 illustrates a plan view of the screening surface to be incorporated into the screening panel in accordance with a preferred embodiment of the present invention.

DETAILED DESCRIPTION OF THE INVENTION

The following describes some preferred embodiments of the present invention, which are purely for the sake of understanding the performance of the invention, and not by way of any sort of limitation.

As stated under the heading "Background of the Invention" in screen panels known in the art, abrasion/wearing of the aperture walls expedites the loss of desired shape of the apertures. This renders such screen panels unfit for the desired operational purpose of allowing materials of desired sizes, to pass through its apertures.

The present invention principally focuses on reducing the abrasion of the aperture walls of the screen panels, so that the desired shapes thereof are retained for a considerably long period of time.

Figure 3:
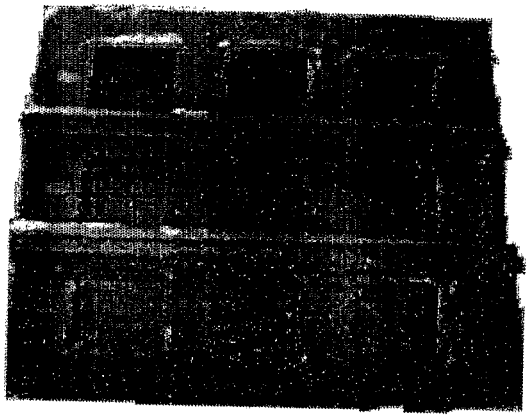
FIG. 3 illustrates a rubber screen deck, on which the screen panel in accordance with the present invention can be mounted.
Figure 4:
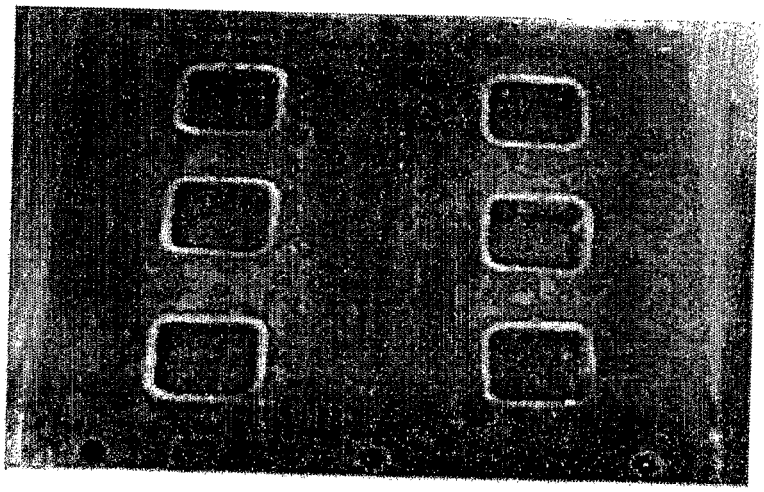
FIG. 4 illustrates a polyurethane screen deck, on which the screen panel in accordance with the present invention can be mounted.

The screen panels are mounted on screen decks for causing screening/separating or grading of minerals in the mining and quarrying industries. The accompanying FIGS. 3 and 4, illustrate two such screen decks made up of rubber and polyurethane respectively. Precisely, the present invention provides a flexible ore-screening panel adapted for mounting on a screening deck, which includes a screening surface integrally formed on a reinforcing frame. Such screen panel has aperture walls made up of abrasion resistant material; hitherto not conceived in the art, which facilitates resistance to abrasion and consequently ensures retention of desired shape of apertures, for a substantially long period of time. This in turn ensures longevity of the screen panels for performing the function of screening desired size range of materials. It would be clear to persons skilled in the art, that the shape of the apertures are designed according to the desired size range that is meant to be allowed to pass there through, depending upon the requirement. So, any distortion in the shape of the aperture renders the whole screen panel in effective for performing such function. It is this aspect which the present invention rather stupendously ameliorates, which was hitherto not conceived in the industry. The walls of the apertures are constructed from abrasion resistant material, which is different from the rest of the screening surface of the screen panel.

Preferably, to achieve the principal object of the present invention and its other objects the screening panel/device for screening mineral ores in accordance with the present invention, includes a screening surface of rubber/polyurethane combined with metallic walls in the apertures to provide both the flexibility of rubber/polyurethane along with harder metallic surface. The rubber/polyurethane helps to take the impact of the materials coming in contact with the screening surface whereas the metallic walls prevent wear of the apertures. Hence, the present invention advocates a complete and cohesive resonance effect, whereby not only is the desired shape of the apertures maintained for a substantially longer period of time due to reduction in abrasion, but also flexibility of the panels is ensured so that the materials of desired size can pass through the apertures. Furthermore, the metallic walls provided in the aperture walls are made such that it further adds on to the flexibility, thereby facilitating easy passage of mineral ores there through without any sort of clogging.

Preferably, the portion of the screening surface of the screen panel in accordance with the present invention, other than the apertures, are made of any one of or a combination of mild steel, stainless steel, rubber and/or polyurethane with or without steel reinforcing.

Figure 1:
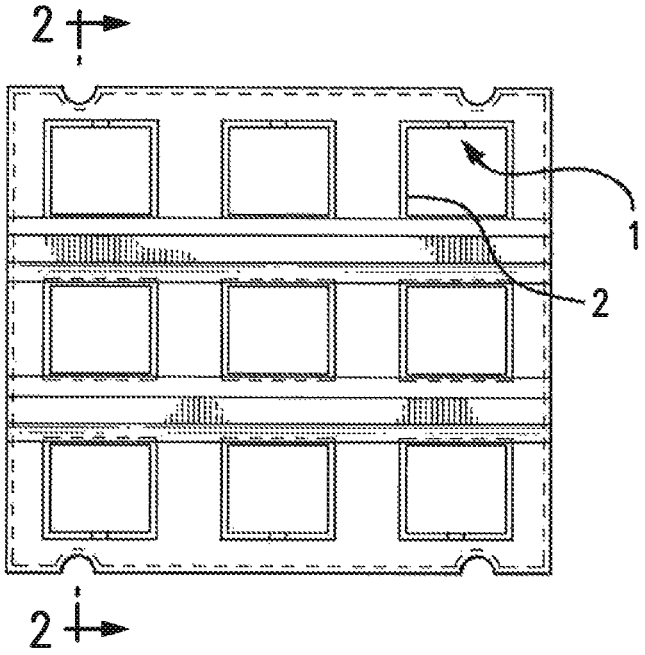

The accompanying FIG. 1 illustrates a plan view of the screening surface, showing the metallic walls of the aperture, in accordance with a preferred embodiment. Preferably, the metallic walls have a slit (1) cut along the vertical line, which enhances the flexibility of the apertures, in addition to its capacity of wear protection and consequently, retention of desired shape.

Figure 2:
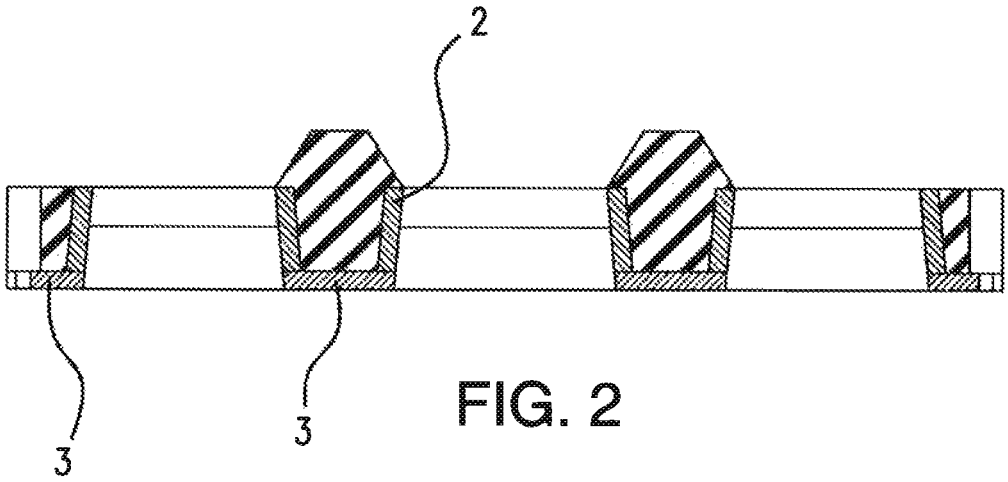
FIG. 2 illustrates a side view of the aperture walls of the screen panel in accordance with a preferred embodiment of the present invention.

Preferably, the panel is hot vulcanized material, rubber/polyurethane, having embedded within it steel reinforcing bars at the outer edges of the panels and extended across the inner area of the panel to provide support to the screening surface as illustrated in accompanying FIG. 1. In this arrangement the apertures used for screening the undersize ores are lined with a metallic wall (2) as illustrated in the accompanying FIG. 2. The metallic walls may have a slit (1) cut along the vertical line, as stated earlier and as illustrated in the accompanying FIG. 1. The metallic protective walls with a slit along the vertical line are mounted on the steel reinforcement such that it becomes an integral part of the reinforcement.

In the above context it is hereby clarified, that simply by way of example and for understanding the present invention and not by way of any limitation, the abrasion resistance walls of the apertures have been explained and stated as metallic. It should be understood to persons skilled in the art that, the walls may be made of other abrasion resistant material as well such as ceramic, cryston or any other highly wear resistant material. These materials can be used for any length along the aperture wall. The thickness of these plates can be anything depending on the aperture size. The present invention is equally effective, in achieving its principal objective as well as its other objectives, on application of any such wear/abrasion resistant material either individually or in combination.

Hitherto known screen decks/screen devices/screen panels were either completely made of rubber, polyurethane or a steel. The present invention advocates that the sides of the apertures or aperture walls are of more abrasion resistant material so that the aperture shape, for which it has been designed, is retained longer. This in turn increases the screen panel life and the screening efficiency remains unaltered with time. The aperture walls are made up of material different than the remaining portion of the screening surface, to retain its shape because of its abrasion/wear resistant trait. Simultaneously, flexibility of the apertures in particular and the screen panel/device in general, is also ensured so that the materials of desired size are allowed to pass through the apertures. This unique cohesive resonance, achieved by the technology in accordance with the present invention was hitherto not conceived by persons skilled in the art.

The method of manufacturing the screen panels in accordance with the present invention includes forming a screening surface of materials such as herein described, on a reinforcing frame. The method also includes designing apertures on said screening surface, of desired shape for allowing materials of desired size to pass through. This is done by constructing the walls of the apertures of abrasion resistant material such as herein described which is different from the rest of the screening surface. This ensures retention of the desired shape of the apertures for a substantially long period of time. Hence, longevity and effectiveness are simultaneously ensured.

The present invention is applicable for all desired shapes of apertures, as required in the industry. The panels may be of different sizes, i.e.—modular type (305×305 mm and 610×300 mm) and larger sizes also. For modular type snap on type fixing, like button type, pin and sleeve type may be provided for mounting on to the screen deck.

The present invention has been described with reference to some drawings and preferred embodiments, purely for the sake of understanding and not by way of any limitation and the present invention includes all legitimate developments within the scope of what has been described hereinbefore and claimed in the appended claims.

The invention claimed is:

1. A screen panel for mining and quarrying industries adapted to be mounted on a screen deck, including a screening surface made up of a material including at least one of mild steel, stainless steel, rubber, and polyurethane formed on a reinforcing frame, said screening surface having apertures shaped for allowing materials of a predetermined size to pass through, said apertures having contiguous walls spanning a length of the aperture and extending between a surface of the screen panel opposite the reinforcing frame and the reinforcing frame, wherein each wall is made of a material having a greater abrasion resistance than the screening surface for retaining the shape of the apertures, wherein said metallic lining forms a metallic wall of said aperture with a slit cut along a vertical line, thereby enhancing the flexibility of said apertures and also ensuring wear protection.

2. The screen panel as claimed in claim 1, wherein said abrasion resistant material includes metallic lining along walls of said apertures.

3. The screen panel as claimed in claim 1 wherein said metallic wall with the slit along the vertical line is adapted to be mounted on the reinforcing frame, such that the walls become an integral part of said reinforcing frame.

4. The screen panel as claimed in claim 1, wherein said screening surface, other than said apertures, are made of any one of or a combination of mild steel, stainless steel, rubber and/or polyurethane without steel reinforcing.

5. The screen panel as claimed in claim 1, wherein said panel comprises one of a vulcanized material, rubber, and polyurethane.

6. The screen as claimed in claim 5, wherein said panel is a modular screen panel.

7. The screen panel as claimed in claim 6, wherein said panel is adapted to button fixing to said screening deck or to sleeve fixing to said screening deck.

8. A screen panel as recited in claim 6, wherein the modular screen panel is a 305 millimeter by 305 millimeter screen panel.

9. A screening deck for mining and quarrying industries, comprising:

at least one screen panel as recited in claim 1.

10. A screen panel as recited in claim 1, wherein each of the apertures include a single contiguous wall integral with the underlying reinforcing frame.

11. A screen panel as recited in claim 10, wherein the contiguous wall is configured and adapted for flexing with the screen panel.

12. A screen panel as recited in claim 1, wherein the at least one of the contiguous walls is laterally bounded by the screening surface.

13. A screen panel for mining and quarrying industries adapted to be mounted on a screen deck, including a screening surface made up of a material including at least one of mild steel, stainless steel, rubber, and polyurethane formed on a reinforcing frame, said screening surface having apertures shaped for allowing materials of a predetermined size to pass through, said apertures having contiguous walls spanning a length of the aperture and extending between a surface of the screen panel opposite the reinforcing frame and the reinforcing frame, wherein each wall is made of a material having a greater abrasion resistance than the screening surface for retaining the shape of the apertures, wherein at least one of the contiguous walls is formed from any one of or a combination of ceramics and cryston.

14. A screen panel for mining and quarrying industries adapted to be mounted on a screen deck, including a screening surface made up of a material including at least one of mild steel, stainless steel, rubber, and polyurethane formed on a reinforcing frame, said screening surface having apertures shaped for allowing materials of a predetermined size to pass through, said apertures having contiguous walls spanning a length of the aperture and extending between a surface of the screen panel opposite the reinforcing frame and the reinforcing frame, wherein each wall is made of a material having a greater abrasion resistance than the screening surface for retaining the shape of the apertures, wherein said panel comprises one of a vulcanized material, rubber, and polyurethane, wherein said panel is a modular screen panel, and wherein the modular screen panel is a 610 millimeter by 310millimeter screen panel.

15. A screen panel for mining and quarrying industries adapted to be mounted on a screen deck, including a screening surface made up of a material including at least one of mild steel, stainless steel, rubber, and polyurethane formed on a reinforcing frame, said screening surface having apertures shaped for allowing materials of a predetermined size to pass through, said apertures having contiguous walls spanning a length of the aperture and extending between a surface of the screen panel opposite the reinforcing frame and the reinforcing frame, wherein each wall is made of a material having a greater abrasion resistance than the screening surface for retaining the shape of the apertures, wherein the contiguous wall is configured and adapted for flexing with the screen panel, wherein opposed ends of the contiguous wall define a vertical slit extending between the surface of the screen panel and the reinforcing screen.

16. A screen panel for mining and quarrying industries adapted to be mounted on a screen deck, including a screening surface made up of a material including at least one of mild steel, stainless steel, rubber, and polyurethane formed on a reinforcing frame, said screening surface having apertures shaped for allowing materials of a predetermined size to pass through, said apertures having contiguous walls spanning a length of the aperture and extending between a surface of the screen panel opposite the reinforcing frame and the reinforcing frame, wherein each wall is made of a material having a greater abrasion resistance than the screening surface for retaining the shape of the apertures, wherein the at least one of the contiguous walls is bounded on an end by an upper surface of the reinforcing frame.

* * * * *